US007506635B2

(12) United States Patent
Omae et al.

(10) Patent No.: US 7,506,635 B2
(45) Date of Patent: Mar. 24, 2009

(54) FUEL INJECTION SYSTEM

(75) Inventors: Kazuhiro Omae, Atsugi (JP); Yoshimasa Watanabe, Sunto-gun (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 347 days.

(21) Appl. No.: 11/547,288

(22) PCT Filed: Sep. 28, 2005

(86) PCT No.: PCT/JP2005/018391

§ 371 (c)(1),
(2), (4) Date: Oct. 3, 2006

(87) PCT Pub. No.: WO2006/038636

PCT Pub. Date: Apr. 13, 2006

(65) Prior Publication Data

US 2008/0264383 A1 Oct. 30, 2008

(30) Foreign Application Priority Data

Oct. 1, 2004 (JP) ..... 2004-289995

(51) Int. Cl.
*F02M 37/04* (2006.01)

(52) U.S. Cl. ..... 123/467; 239/96

(58) Field of Classification Search ..... 123/467; 239/88–96

See application file for complete search history.

(56) References Cited

U.S. PATENT DOCUMENTS 5,622,152 A 4/1997 Ishida
5,893,350 A * 4/1999 Timms ..... 123/467
6,340,018 B1 * 1/2002 Mattes ..... 123/467
6,463,914 B2 * 10/2002 Augustin et al. ..... 123/502
6,481,419 B2 * 11/2002 Boecking ..... 123/467
6,725,841 B1 * 4/2004 Boecking ..... 123/467
6,904,893 B2 6/2005 Hotta et al.
6,915,785 B2 * 7/2005 Eisenmenger et al. ..... 123/446
7,201,149 B2 * 4/2007 Magel ..... 123/467
7,290,530 B2 * 11/2007 Boecking ..... 123/467
7,412,969 B2 * 8/2008 Pena et al. ..... 123/467
2002/0088435 A1 7/2002 Kropp et al.
2004/0025843 A1 2/2004 Magel (Continued)

FOREIGN PATENT DOCUMENTS

JP U 3-60665 6/1991

(Continued)

*Primary Examiner*—Thomas N Moulis
(74) *Attorney, Agent, or Firm*—Oliff & Berridge, PLC

(57) ABSTRACT

A first valve element (32) and second valve element (34) are arranged in a pressure switching chamber (30) of a three-way valve (8). When switching a destination of a fuel flow passage (15) from a high pressure fuel feed passage (5*a*) to a low pressure fuel return passage (26*a*), the state where the first valve element (32) is open and the second valve element (34) is closed is switched through a state where the first valve element (32) and second valve element (34) are both closed to a state where the first valve element (32) is closed and the second valve element (34) is open. Fuel pressure of a pressure control port (55) sealed by a sliding seal face (53) formed at an outer circumference of the second valve element (34) is used to control an opening timing of a needle valve (9).

6 Claims, 13 Drawing Sheets

U.S. PATENT DOCUMENTS

| | | | | |
|---|---|---|---|---|
| 2004/0178283 | A1* | 9/2004 | Boehland | 239/88 |
| 2005/0035212 | A1* | 2/2005 | Eisenmenger et al. | 239/88 |

FOREIGN PATENT DOCUMENTS

| | | |
|---|---|---|
| JP | A 5-180369 | 7/1993 |
| JP | A 6-101591 | 4/1994 |
| JP | A 8-21332 | 1/1996 |
| JP | A 10-238432 | 9/1998 |
| JP | A 2002-202021 | 7/2002 |
| JP | A 2003-106235 | 4/2003 |
| JP | A 2003-515047 | 4/2003 |
| JP | A 2004-44493 | 2/2004 |
| JP | A 2004-44494 | 2/2004 |
| JP | A 2004-519614 | 7/2004 |

* cited by examiner (A)

(B)

(A)

(B)

(A)

(B)

(C)

(A)

(B)

FUEL INJECTION SYSTEM

TECHNICAL FIELD

The present invention relates to a fuel injection system.

BACKGROUND ART

In a fuel injection system of an internal combustion engine, a three-way valve is provided which is able to selectively connect a back pressure control chamber formed on an inside end face of a needle valve and an intermediate chamber of a booster piston for increasing an injection pressure to a high pressure fuel feed passage or low pressure fuel return passage. A fuel injection system designed to use the fuel passage switching action of this three-way valve for control for opening and closing a needle valve and for control for increasing the injection pressure by the booster piston is known (for example, see Japanese Patent Publication (A) No. 2003-106235). In this fuel injection system, the fuel passage switching operation by the three-way valve enables the phase difference between the opening timing of the needle valve and the start timing of the boosting action by the booster piston to be changed and thereby enables the injection rate of the fuel to be controlled to a desirable injection rate for the engine operating state.

However, in this fuel injection system, at the time of the fuel passage switching action by the three-way valve, the high pressure fuel feed passage ends up being connected with the low pressure fuel return passage. As a result, the problem arises of a large amount of high pressure fuel in the high pressure fuel feed passage ending up leaking into the low pressure fuel return passage. Further, if a large amount of high pressure fuel ends up leaking in this way, the problem also arises of the high pressure fuel pump feeding the high pressure fuel becoming insufficient in capacity.

DISCLOSURE OF THE INVENTION

An object of the present invention is to provide a fuel injection system able to prevent a large amount of high pressure fuel from leaking into a low pressure fuel return passage at the time of a fuel passage switching action by a three-way valve.

According to the present invention, there is provided a fuel injection system provided with a three-way valve able to selectively connect a back pressure control chamber formed on an inside end face of a needle valve and an intermediate chamber of a booster piston for increasing an injection pressure to a high pressure fuel feed passage or low pressure fuel return passage and, control for opening and closing a needle valve and control for increasing the injection pressure by the booster piston are performed by using the fuel passage switching action by the three-way valve, wherein a pressure switching chamber constantly connected to either the back pressure control chamber or intermediate chamber is formed in the three-way valve, the high pressure fuel feed passage is open to one side of the pressure switching chamber, a first valve element for controlling the opening and closing of the opening of the high pressure fuel feed passage is provided, the low pressure fuel return passage is open to the other side of the pressure switching chamber, a second valve element for controlling the opening and closing of the opening of this low pressure fuel return passage is provided, the three-way valve is provided with a pressure control chamber, fuel pressure in the pressure control chamber is controlled so as to control a pressure difference of fuel pressures acting at the two ends of the first valve element in an axial direction of the first valve element and a pressure difference of fuel pressures acting at the two ends of the second valve element in an axial direction of the second valve element so that when switching the destination of either the back pressure control chamber or intermediate chamber from the high pressure fuel feed passage to the low pressure fuel return passage, the state where the first valve element is open and the second valve element is closed is changed through a state where the first valve element and second valve element are both closed to a state where the first valve element is closed and the second valve element is open and so that when switching the destination of either the back pressure control chamber or intermediate chamber from the low pressure fuel return passage to the high pressure fuel feed passage, the state where the first valve element is closed and the second valve element is open is changed through a state where the first valve element and second valve element are both closed to a state where the first valve element is open and the second valve element is closed, and the other of the back pressure control chamber or intermediate chamber is connected with the pressure switching chamber when second valve element is open or is constantly connected with the pressure control chamber.

BEST MODE FOR WORKING THE INVENTION

Figure 1:
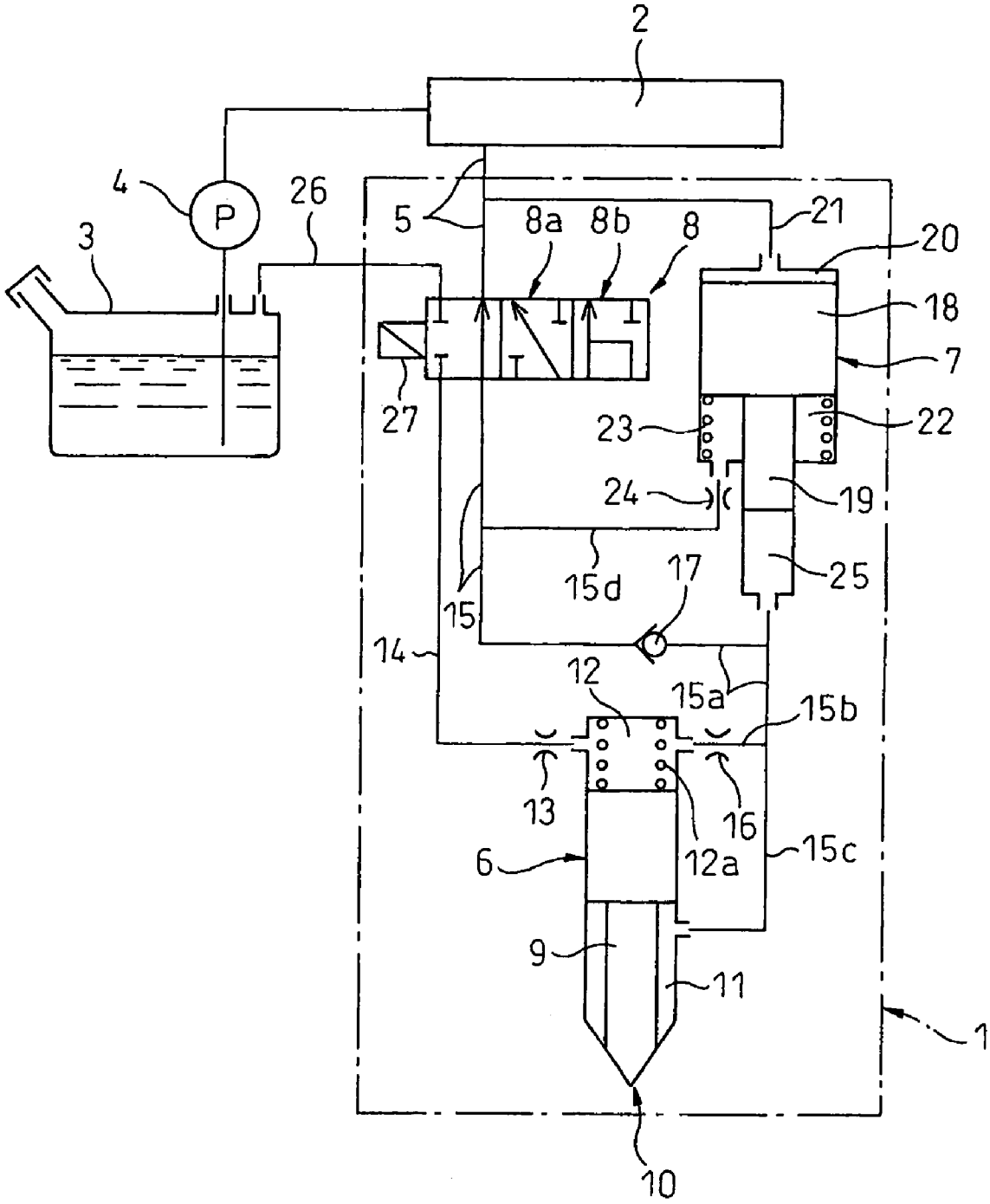
FIG. 1 is an overview of a fuel injection system.

FIG. 1 shows a fuel injection system as a whole diagrammatically. In FIG. 1, a part 1 surrounded by a one-dot chain line shows a fuel injector attached to an engine. As shown in FIG. 1, the fuel injection system is provided with a common rail 2 for storing high pressure fuel. This common rail 2 is supplied with fuel from a fuel tank 3 through a high pressure fuel pump 4. The fuel pressure in the common rail 2 is maintained at a target fuel pressure corresponding to an engine operating state by controlling the amount of discharge of the high pressure fuel pump 4. The high pressure fuel in the common rail 2 maintained at the target fuel pressure is supplied through a high pressure fuel feed passage 5 to the fuel injector 1.

As shown in FIG. 1, the fuel injector 1 is provided with a nozzle portion 6 for injecting fuel into a combustion chamber, a booster 7 for boosting the injection pressure, and a three-way valve 8 for switching fuel passages. The nozzle portion 6 is provided with a needle valve 9. The nozzle portion 6 is formed at its front end with an injection port 10 (not shown) controlled to open and close by a front end of the needle valve 9. Around the needle valve 9 is formed a nozzle chamber 11 filled with injected high pressure fuel. Above the inside end face of the needle valve 9 is formed a back pressure control chamber 12 filled with fuel. Inside the back pressure control chamber 12 is inserted a compression spring 12*a* biasing the needle valve 9 downward, that is, in the closing direction. This back pressure control chamber 12 on the one hand is connected through a constriction 13 and a fuel flow passage 14 to the three-way valve 8 and on the other hand is connected to a fuel flow passage 15*b* and through a constriction 16 smaller in flow cross-sectional area than the constriction 13 to a fuel flow passage 15*a*. Further, the nozzle chamber 11 is also connected through a fuel flow passage 15*c* to the fuel flow passage 15*a*. This fuel flow passage 15*a* is connected to the fuel flow passage 15 through a check valve 17 enabling communication only from the fuel flow passage 15 toward the fuel flow passage 15*a*.

On the other hand, the booster 7 is provided with an integrally formed booster piston comprised of a large diameter piston 18 and small diameter piston 19. Above the top face of the large diameter piston 18 at the opposite side to the small diameter piston 19 is formed a high pressure chamber 20 filled with high pressure fuel. This high pressure chamber 20 is connected through a high pressure fuel passage 21 to the high pressure fuel feed passage 5. Therefore, inside the high pressure chamber 20, the fuel pressure inside the common rail 2 (below, referred to as the "common rail pressure") constantly acts. As opposed to this, above the end face of the large diameter piston 18 around the small diameter piston 19 is formed an intermediate chamber 22 filled with fuel. Inside this intermediate chamber 22 is inserted a compression spring 23 for biasing the large diameter piston 18 toward the high pressure chamber 20. This intermediate chamber 22 is connected through a constriction 24 and the fuel flow passage 15*a* to the fuel flow passage 15. Further, above the end face of the small diameter piston 19 at the opposite side to the large diameter piston 18 is formed a booster chamber 23 filled with fuel. This booster chamber 25 is connected with the fuel flow passage 15*a*.

On the other hand, the three-way valve 8 has connected with it, in addition to the high pressure fuel feed passage 5 and fuel flow passages 14 and 15, for example, a low pressure fuel return passage 26 connected to the inside of the fuel tank 3. This three-way valve 8 is driven by an electromagnetic solenoid or piezoelectric device or other such actuator 27. Due to this three-way valve 8, the fuel flow passages 14 and 15 are selectively connected with the high pressure fuel feed passage 5 or low pressure fuel return passage 26.

FIG. 1 shows the case where the fuel passage switching action by the three-way valve 8 results in the fuel flow passage 15 being connected with the high pressure fuel feed passage 5. In this case, at the nozzle portion 6, both the inside of the nozzle chamber 11 and the inside of the back pressure control chamber 12 become the common rail pressure. At this time, the force due to the fuel pressure in the nozzle chamber 11 acting to raise the needle valve 9 is weaker than the force due to the fuel pressure in the back pressure control chamber 12 and the spring force of the compression spring 13 acting to lower the needle valve 9. For this reason, the needle valve 9 is made to descend. As a result, the needle valve 9 closes, so fuel injection from the injection port 10 is stopped. On the other hand, regarding the booster 7, at this time, the inside of the high pressure chamber 20, the inside of the intermediate chamber 22, and the inside of the booster chamber 25 are all at the common rail pressure. Therefore, at this time, as shown in FIG. 1, the booster piston comprised of the large diameter piston 18 and small diameter piston 19 is held in a state raised by the spring force of the compression spring 23.

On the other hand, when the passage switching action of the three-way valve 8 results in the three-way valve 8 entering the switching state shown in FIG. 1, that is, when the fuel flow passage 15 is connected with the low pressure fuel return passage 26, the intermediate chamber 22 falls in fuel pressure, so the booster piston comprised of the large diameter piston 18 and small diameter piston 19 is subjected to a large downward direction force and, as a result, the booster chamber 25 becomes higher in fuel pressure than the common rail pressure. Therefore, at this time, the nozzle chamber 11 connected through the fuel flow passages 15*a*, 15*c* to the inside of the booster chamber 25 also becomes higher in fuel pressure than the common rail pressure. Next, when the passage switching action by the three-way valve 8 results in the three-way valve 8 entering the switching state shown by 8*b* in FIG. 1, that is, not only the fuel flow passage 15, but also the fuel flow passage 14 are connected with the low pressure fuel return passage 26, the back pressure control chamber 12 of the nozzle portion 6 falls in fuel pressure, so the needle valve 9 rises and, as a result, the needle valve 9 is open and fuel in the nozzle chamber 11 is injected from the injection port 10. Therefore, by changing the timing at which the three-way valve 8 switches the switching state from 8*a* to 8*b*, it is possible to change the phase difference between the boosting start timing of the injection pressure by the booster piston comprised of the large and small pistons 18, 19 and the opening timing of the needle valve 9.

Next, when the fuel passage switching action by the three-way valve 8 results in, as shown in FIG. 1, the fuel flow passage 15 being connected again with the high pressure fuel feed passage 5, the back pressure control chamber 12 of the nozzle portion 6 becomes the common rail pressure and, as a result, fuel injection is stopped. Further, at this time, the intermediate chamber 22 of the booster 7 also becomes the common rail pressure, the booster chamber 25 also becomes the common rail pressure, and the large diameter piston 18 and small diameter piston 19 are held in the state raised by the spring force of the compression spring 23 again as shown in FIG. 1. In this way, the fuel passage switching action by the three-way valve 8 is used for control of the fuel injection.

Figure 2:
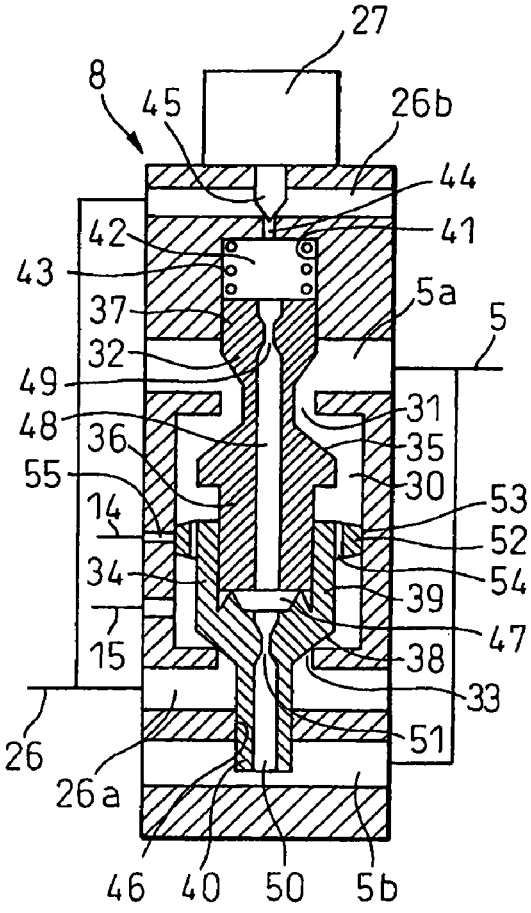
FIG. 2 is a side sectional view of a first embodiment of a three-way valve.
Figure 2:
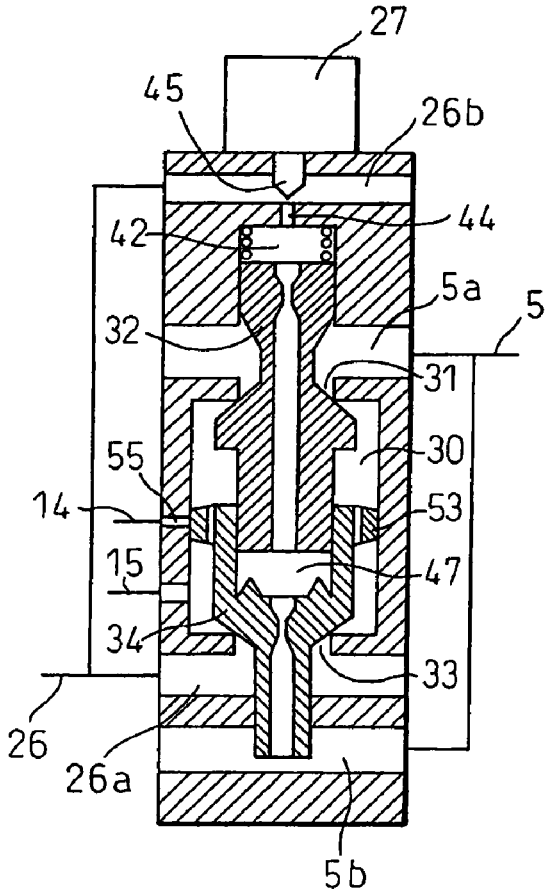
Figure 3:
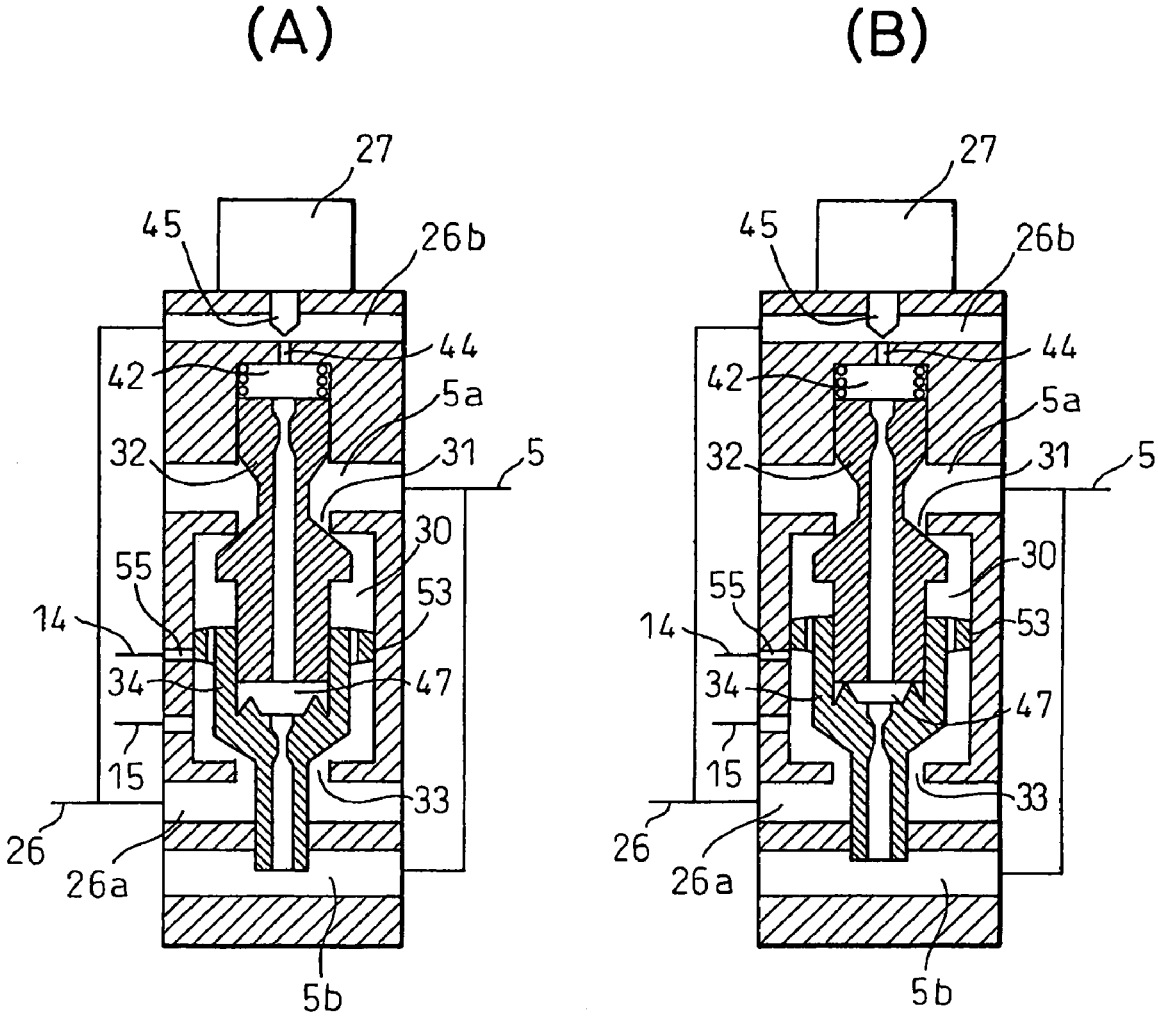
FIG. 3 is a side sectional view of a first embodiment of a three-way valve.

FIG. 2(A) shows a first embodiment of the three-way valve 8 shown in FIG. 1. Referring to FIG. 2(A), inside the three-way valve 8, parts of the high pressure fuel feed passage 5, that is, the high pressure fuel feed passages 5*a*, 5*b*, and parts of the low pressure fuel return passage 26, that is, the low pressure fuel return passages 26*a*, 26*b*, extend. Further, inside the three-way valve 8 is formed a pressure switching chamber 30. In this first embodiment, the pressure switching chamber 30 is constantly connected with the fuel flow passage 15. One side of the pressure switching chamber 30 opens to the high pressure fuel feed passage 5*a*, while the other side of the pressure switching chamber 30 opens to the low pressure fuel return passage 26*a*. The opening 31 of this high pressure fuel feed passage 5*a* is controlled to open and close by a first valve element 32, while the opening 33 of the low pressure fuel return passage 26*a* is controlled to open and close by a second valve element 34.

The first valve element 32 is provided with a conical seal part 35 formed at the center in the axial direction and able to seal the opening 31 from the pressure switching chamber 30 side, a cylindrical inside end 36, and a cylindrical outside end 37, while the second valve element 34 is provided with a conical seal portion 38 formed at the center in the axial direction and able to seal the opening 33 from the pressure switching chamber 30 side, a hollow cylindrical shape inside end 39, and a cylindrical outside end 40. As shown in FIG. 2(A), the first valve element 32 and the second valve element 34 are arranged on a common axis, and the cylindrical inside end 36 of the first valve element 32 is slidably fit inside the hollow cylindrical shape inside end 39 of the second valve element 34.

The cylindrical outside end 37 of the first valve element 32 is slidably inserted into a cylindrical recess 41. Inside the cylindrical recess 41 defined by the cylindrical outside end 37 of this first valve element 32, a pressure control chamber 42 is formed. Inside this pressure control chamber 42 is inserted a compression spring 43 for biasing the first valve element 32 toward the second valve element 34. The pressure control chamber 42 is connected through a constriction opening 44 to the low pressure fuel return passage 26*b*. This constriction opening 44 is controlled to open and close by a discharge control valve 45 driven by the actuator 27.

The cylindrical outside end 40 of the second valve element 34 is inserted slidably inside a cylindrical bore 46 and sticks out into the high pressure fuel feed passage 5*b*. On the other hand, the mutually engaged cylindrical inside end 36 of the first valve element 32 and hollow cylindrical shape inside end 39 of the second valve element 34 form between them an intermediate pressure chamber 47. This intermediate pressure chamber 47 is, on the one hand, connected through the fuel passage 48 and constriction 49 formed in the first valve element 32 to the pressure control chamber 42 and, on the other hand, connected through the fuel passage 50 and constriction 51 formed in the second valve element 34 to the high pressure fuel feed passage 5*b*.

Note that in the first embodiment shown in FIG. 2(A), the diameters of the cylindrical inside end 36 and cylindrical outside end 37 of the first valve element 32 and the diameters of the openings 31, 33 are all equal, and the cylindrical outside end 40 of the second valve element 34 has a smaller diameter compared with this diameter. Therefore, the first valve element 32 is acted on only by the fuel pressure inside the pressure control chamber 42 and the fuel pressure inside the intermediate pressure chamber 47 in the axial direction. The opening and closing action of the opening 31 by the seat part 35 of the first valve element 32, that is, the opening and closing action of the first valve element 32, is controlled by the pressure difference between the fuel pressure acting on the outside end 37 of the first valve element 32 toward the axial direction and the fuel pressure acting on the inside end 36 of the first valve element 32 toward the axial direction. This pressure difference is controlled by a pressure control system comprised of the actuator 27 and discharge control valve 45.

On the other hand, the inside end 39 of the second valve element 34 is acted on by the fuel pressure of the intermediate pressure chamber 47, while the outside end 40 of the second valve element 34 is acted on by the fuel pressure in the high pressure fuel feed passage 5*b*. In this second valve element 34 as well, basically the opening and closing action of the opening 33 by the seat portion 38 of the second valve element 34, that is, the opening and closing action of the second valve element 34, is controlled in accordance with the pressure difference between the fuel pressure acting on the outside end 40 of the second valve element 34 toward the axial direction and the fuel pressure acting on the inside end 39 of the second valve element 34 toward the axial direction. This pressure difference is controlled by a pressure control system comprised of the actuator 27 and discharge control valve 45.

On the other hand, as shown in FIG. 2(A), the outer circumference of the hollow cylindrical shape inside end 39 of the second valve element 34 is formed with a ridge 52 extending completely around it. The outer circumference of this ridge 52 is formed with a sliding seal face 53 sliding along the inner circumference of the pressure switching chamber 30. Further, the ridge 52 is formed with a plurality of communicating holes 54 connecting the parts of the pressure switching chamber 30 above and below the ridge 52 in FIG. 2(A). Further, the inner circumference of the pressure switching chamber 30 is formed with a pressure control port 55 able to be sealed by the sliding seal face 53 of the second valve element 34. This pressure control port 55 is connected through the fuel flow passage 14 to the back pressure control chamber 12. As shown in FIG. 2(A), when the second valve element 34 is closed, this pressure control port 55 is sealed by the sliding seal face 53 of the second valve element 34.

Figure 4:
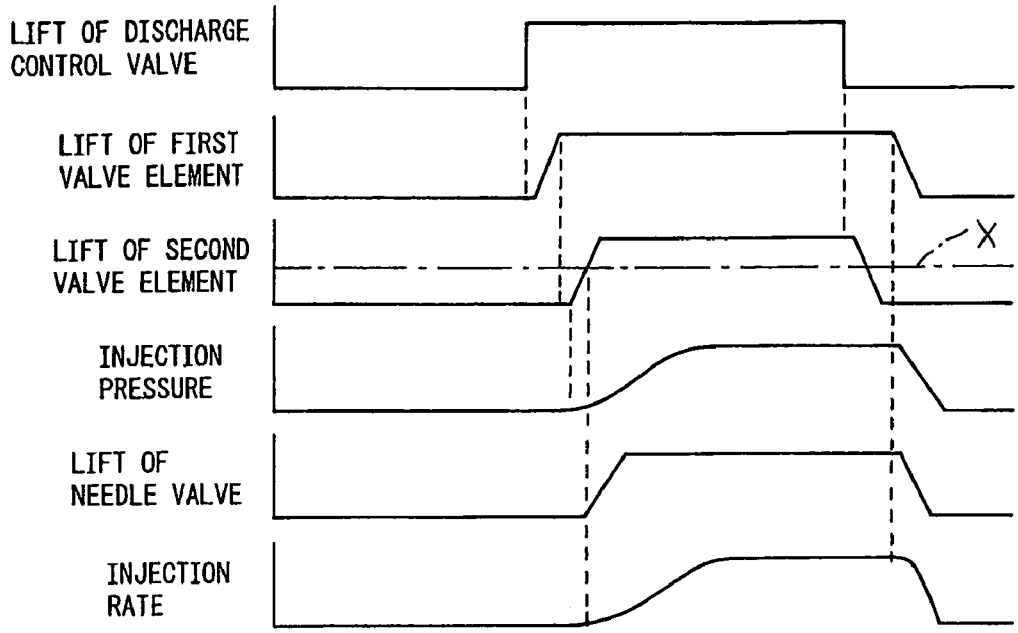
FIG. 4 is a time chart showing changes in an injection rate etc.
Figure 4:
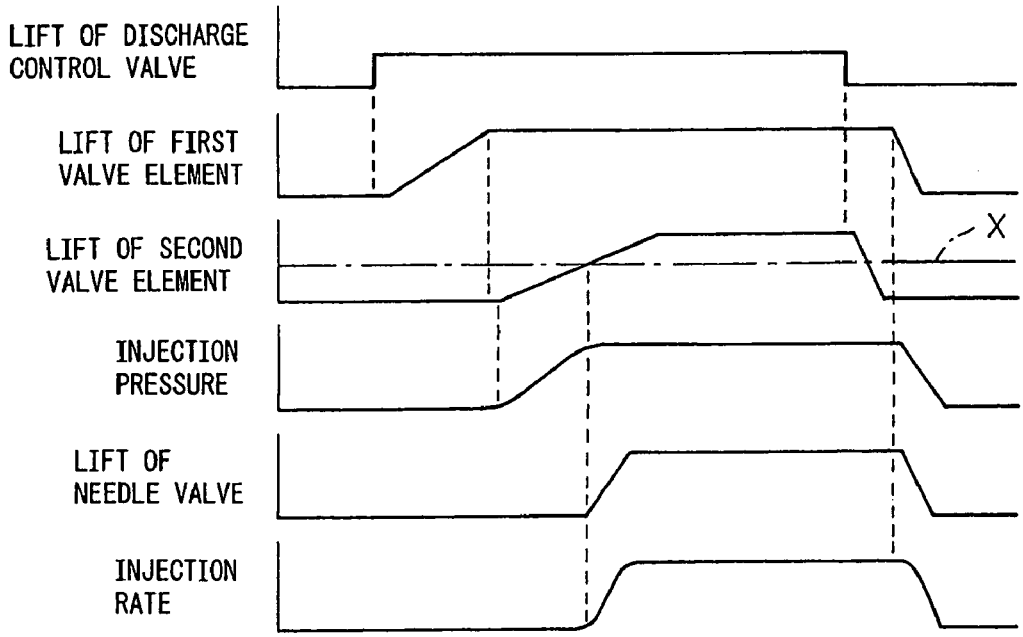

FIGS. 4(A) and (B) show the changes in the amount of lift of the first valve element 32, the amount of lift of the second valve element 34, the injection pressure, the amount of lift of the needle valve 9, and the injection rate when the discharge control valve 45 is opened for the fuel injection. Further, FIG. 4(A) shows the case where the amount of lift of the discharge control valve 45 is large, while FIG. 4(B) shows the case where the amount of lift of the discharge control valve 45 is small. Next, referring to FIG. 1 to FIG. 4, the fuel injection method according to the present invention will be explained.

As shown in FIG. 2(A), when the discharge control valve 45 seals the constriction opening 44, the pressure control chamber 42 and intermediate pressure chamber 47 are connected only with the high pressure fuel feed passage 5*b*, therefore, at this time, the pressure control chamber 42 and intermediate pressure chamber 47 become equal in fuel pressure to the fuel pressure in the high pressure fuel feed passage 5*b*. Note that below the fuel pressure in the high pressure fuel feed passages 5, 5*a*, and 5*b* will be called the "high fuel pressure", while the fuel pressure in the low pressure fuel return passages 26, 26*a*, and 26*b* will be called the "low fuel pressure".

In this way, when the fuel pressure in the intermediate pressure chamber 47 becomes the high fuel pressure, the working area of the high fuel pressure acting on the second valve element 34 at this time becomes far greater than at the inside end 39 than the outside end 40, so the second valve element 34 is held in the closed state as shown in FIG. 2(A). At this time, as explained above, the pressure control port 55 is sealed by the sliding seal face 53 of the second valve element 34. Further, at this time, the fuel pressure in the pressure control chamber 42 and the fuel pressure in the intermediate pressure chamber 47 both become the high fuel pressure, so the first valve element 32 moves toward the second valve element 34 by the spring force of the compression spring 43 until it strikes the second valve element 34. As a result, as shown in FIG. 2(A), the first valve element 32 is held in the open state. At this time, the fuel flow passage 15 is connected through the pressure switching chamber 30 and opening 31 to the high pressure fuel feed passage 5*a*.

When switching the destination of the fuel flow passage 15 from the high pressure fuel feed passage 5*a* to the low pressure fuel return passage 26*a*, the discharge control valve 45 opens the constriction opening 44. If the discharge control valve 45 opens the constriction opening 44, the fuel in the pressure control chamber 42 starts to be discharged into the low pressure fuel return passage 26*b* and as a result the pressure control chamber 42 gradually falls in fuel pressure. Next, if the pressure control chamber 42 falls in fuel pressure to below the closing pressure for closing the first valve element 32, the first valve element 32 closes as shown in FIG. 2(B). In this case, if the amount of lift of the discharge control valve 45 when the discharge control valve 45 opens the constriction opening 44 is large, the speed of fall of the fuel pressure in the pressure control chamber 42 will be fast, so, as shown in FIG. 4(A), the first valve element 32 will rapidly close. As opposed to this, if the amount of lift of the discharge control valve 45 when the discharge control valve 45 opens the constriction opening 44 is small, the speed of fall of the fuel pressure in the pressure control chamber 42 will be slow, so, as shown in FIG. 4(B), the first valve element 32 will slowly close.

On the other hand, if the discharge control valve 45 is opened and the pressure control chamber 42 starts to fall in fuel pressure, the fuel in the intermediate pressure chamber 47 starts to flow out through the fuel passage 48 to the pressure control chamber 42 and, as a result, the intermediate pressure chamber 47 also starts to fall in fuel pressure. However, the fuel passage 48 is provided with the constriction 49 and, further, fuel is supplied from the high pressure fuel feed passage 5*b* through the fuel passage 50 to the intermediate pressure chamber 47, so the intermediate pressure chamber 47 falls in fuel pressure slower than the fuel pressure in the pressure control chamber 42. Therefore, as shown in FIG. 2(B) and FIG. 4, even if the first valve element 32 closes, the second valve element 34 is held in the closed state.

Next, when the intermediate pressure chamber 47 further falls in fuel pressure and the intermediate pressure chamber 47 falls in fuel pressure to below the opening pressure for opening the second valve element 34, as shown in FIG. 3(A), the first valve element 32 remains closed and, in that state, the second valve element 34 starts to open. As a result, the fuel flow passage 15 is connected through the pressure switching chamber 30 and opening 33 to the low pressure fuel return passage 26*a*.

If the fuel flow passage 15 is connected with the low pressure fuel return passage 26, the intermediate chamber 22 of the booster 7 gradually falls in fuel pressure. As a result, the boosting action of the booster piston comprised of the large and small pistons 18, 19 causes the fuel pressure of the nozzle chamber 11, that is, the injection pressure, to gradually increase as shown in FIGS. 4(A) and (B). Note that as will be understood from FIGS. 4(A) and (B), at this time, the speed of increase of the injection pressure is substantially unaffected by the amount of lift of the discharged control valve 45. Further, when the second valve element 34 starts to open, as shown in FIG. 3(A), the pressure control port 55 remains sealed by the sliding seal face 53 of the second valve element 34.

If the intermediate pressure chamber 47 further falls in fuel pressure, the second valve element 34 increases in the amount of lift, and the amount of lift of the second valve element 34 exceeds the predetermined amount of lift X shown in FIGS. 4(A) and (B), that is, if the second valve element 34 opens by a certain opening degree or more, as shown in FIG. 3(B), the pressure control port 55 opens at the pressure switching chamber 30 and, as a result, the back pressure control chamber 12 is connected through the pressure switching chamber 30 and opening 33 to the low pressure fuel return passage 26*a*. If the back pressure control chamber 12 is connected with the low pressure fuel return passage 26*a*, as shown in FIGS. 4(A) and (B), the needle valve 9 is opened and fuel injection is started.

As explained above, if the first valve element 32 closes, the second valve element 34 opens, but at this time, if the discharge control valve 45 is large in amount of lift, the second valve-element 34 rapidly opens as shown in FIG. 4(A), while if the discharge control valve 45 is small in amount of lift, the second valve element 34 slowly opens as shown in FIG. 4(B). If the second valve element 34 rapidly opens, as shown in FIG. 4(A), the needle valve 9 is opened before the injection pressure increases and, as a result, the injection rate slowly becomes larger at the start of injection. As opposed to this, if the second valve element 34 slowly opens, as shown in FIG. 4(B), the needle valve 9 is opened after the injection pressure increases and, as a result, the injection rate rapidly becomes larger at the start of injection.

In this way, in this embodiment, it is possible to change the amount of lift of the discharge control valve 45 so as to change the speed of fall of the fuel pressure in the pressure control chamber 42 and thereby greatly change the injection rate at the start of injection. Further, it is possible not to change the amount of lift of the discharge control valve 45, but to change the opening speed of the discharge control valve 45 so as to change the speed of fall of the fuel pressure in the pressure control chamber 42 and thereby change the injection rate at the start of injection.

As explained above, when switching the destination of the fuel flow passage 15 from the high pressure fuel feed passage 5*a* to the low pressure fuel return passage 26*a*, the state as shown in FIG. 2(A) where the first valve element 32 is opened and the second valve element 34 is closed is switched through the state as shown in FIG. 2(B) where the first valve element 32 and second valve element 34 are both closed to a state as shown in FIGS. 3(A) and (B) where the first valve element 32 is closed and the second valve element 34 is open. On the other hand, when switching the destination of the fuel flow passage 15 from the low pressure fuel return passage 26*a* to the high pressure fuel feed passage 5*a*, the opening 44. When the discharge control valve 45 closes the constriction opening 44, the intermediate pressure chamber 47 and pressure control chamber 42 are supplied with fuel from the high pressure fuel feed passage 5*a*. At this time, the pressure control chamber 42 rises slower in fuel pressure than the fuel pressure of the intermediate pressure chamber 47 until reaching a high fuel pressure.

Therefore, at this time, the first valve element 32 and second valve element 34 switch from the state shown in FIG. 3(B) through the state shown in FIG. 3(A) and FIG. 2(B) to the state shown in FIG. 2(A). That is, at this time, the state where the first valve element 32 is closed and the second valve element 34 is open is switched through the state where the first valve element 32 and second valve element 34 are both closed to the state where the first valve element 32 is open and the second valve element 34 is closed.

In this way, when switching the destination of the fuel flow passage 15 from the high pressure fuel feed passage 5*a* to the low pressure fuel return passage 26*a*, the valve elements 32 and 34 are made to move in the order of FIGS. 2(A) and (B) and FIGS. 3(A) and (B), but, as will be understood from FIGS. 2(A) and (B) and FIGS. 3(A) and (B), during this time, the high pressure fuel feed passage 5*a* is not connected with the low pressure fuel return passage 26*a* in the pressure switching chamber 30 and consequently a large amount of high pressure fuel does not leak into the low pressure fuel return passage 26*a*. On the other hand, even when switching the destination of the fuel flow passage 15 from the low pressure fuel return passage 26*a* to the high pressure fuel feed passage 5*a*, the high pressure fuel feed passage 5*a* is not connected with the low pressure fuel return passage 26*a* in the pressure switching chamber 30 and consequently a large amount of high pressure fuel can be prevented from leaking into the low pressure fuel return passage 26*a*.

Figure 5:
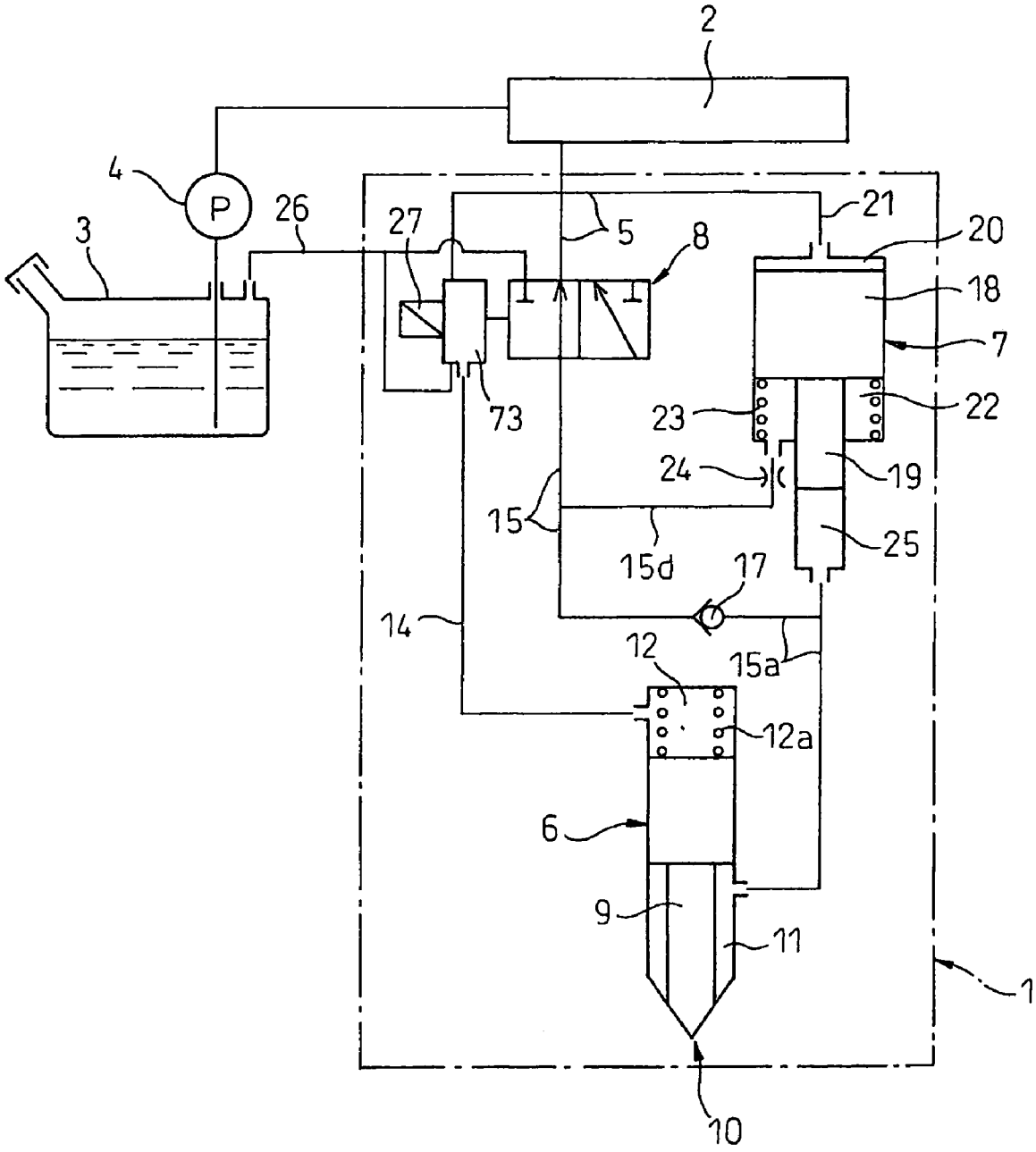
FIG. 5 is an overview of a fuel injection system.
Figure 6:
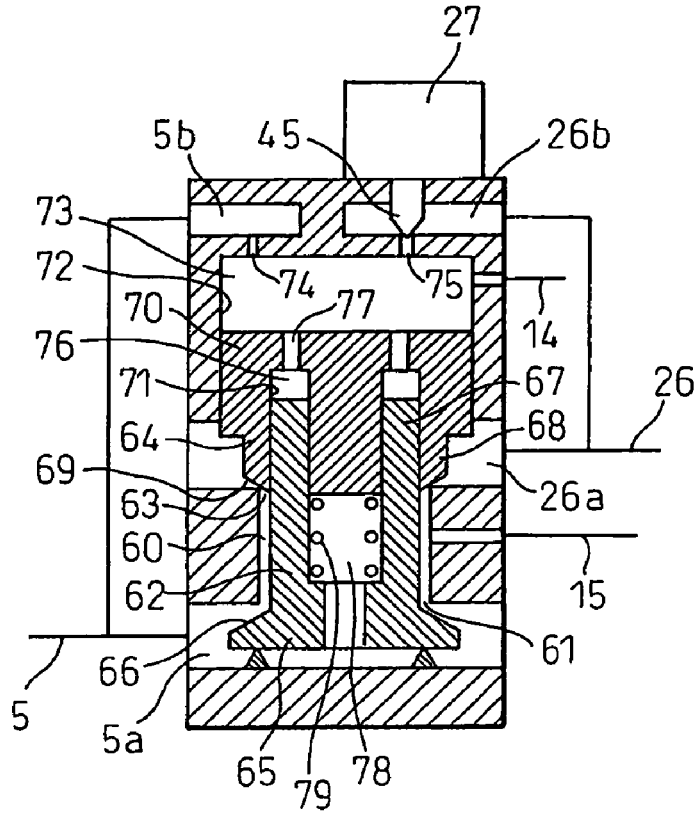
FIG. 6 is a view of a second embodiment of a three-way valve.
Figure 6:
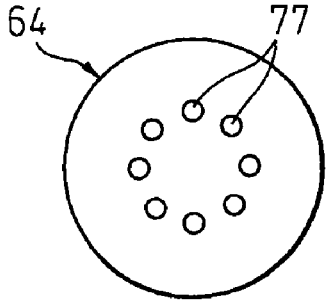
Figure 6:
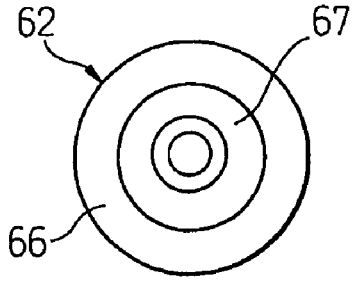
Figure 7:
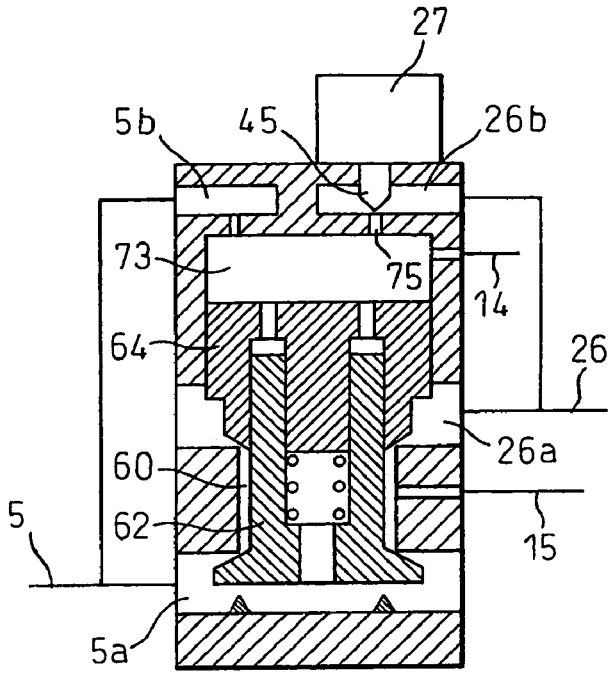
FIG. 7 is a side sectional view of a second embodiment of a three-way valve.
Figure 7:
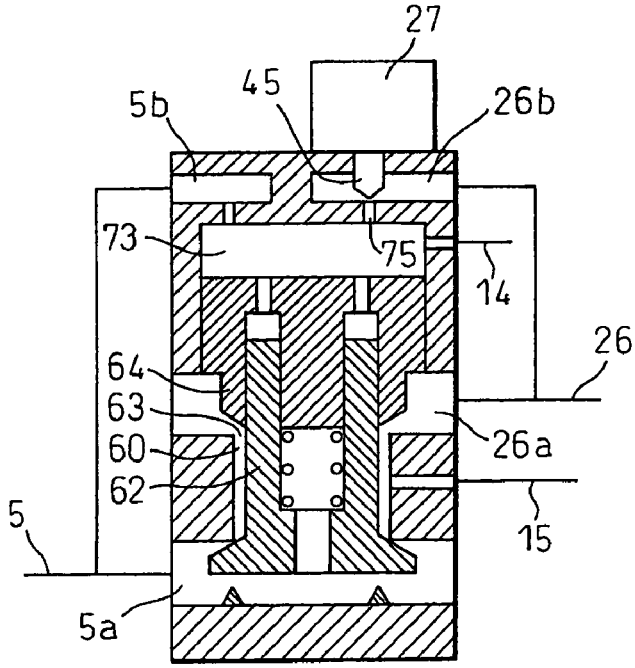

FIG. 5 shows a second embodiment of the fuel injection system, while FIG. 6(A) shows the three-way valve 8 shown in FIG. 5. Referring to FIG. 6(A), in this second embodiment as well, inside the three-way valve 8, parts of the high pressure fuel feed passage 5, that is, the high pressure fuel feed passages 5*a*, 5*b*, and parts of the low pressure fuel return passage 26, that is, the low pressure fuel return passages 26*a*, 26*b*, extend. Further, inside the three-way valve 8 is formed a pressure switching chamber 60. This pressure switching chamber 60 is constantly connected with the fuel flow passage 15.

This fuel flow passage 15, as shown in FIG. 5, is on the one hand connected through the check valve 17 and fuel flow passage 15*a* to the nozzle chamber 11 and booster chamber 25 and, on the other hand, connected through the fuel flow passage 15*d* and constriction 24 to the intermediate chamber 22. One side of the pressure switching chamber 60 has opened at it the high pressure fuel feed passage 5*a*, while the other side of the pressure switching chamber 60 has opened at it the low pressure fuel return passage 26*a*. An opening 61 of this high pressure fuel feed passage 5*a* is controlled to open and close by a first valve element 62, while an opening 63 of the low pressure fuel return passage 26*a* is controlled to open and close by a second valve element 64.

The first valve element 62 forms a hollow cylindrical shape. The first valve element 62 is formed at its outside end 65 with a conical seal portion 66 able to seal the opening 61 from the high pressure fuel feed passage 5*a* side. FIG. 6(C) is a plan view of this first valve element 62. On the other hand, the second valve element 64 is formed at its inside end 68 with a conical seal portion 69 able to seal the opening 63 from the low pressure fuel return passage 26*a* side. FIG. 6(B) is a plan view of this second valve element 64. Above the inside end face of this second valve element 64 is formed an annular groove 71 forming an annular shape around the axis of the second valve element 64. As shown in FIG. 6(A), the first valve element 62 and the second valve element 64 are arranged on a common axis, and the hollow cylindrical shape inside end 67 of the first valve element 62 is slidably fit into the annular groove 71 formed in the second valve element 64.

The cylindrical outside end 70 of the second valve element 64 is slidably inserted into a cylindrical recess 72. Inside the cylindrical recess 72 defined by the cylindrical outside end 70 of this second valve element 64 is formed a pressure control chamber 73. This pressure control chamber 73 is, on the one hand, connected through a constriction 74 to the high pressure fuel feed passage 5*b* and, on the other hand, connected through a constriction opening 75 to the low pressure fuel return passage 26*b*. This constriction opening 75 is controlled to open and close by the discharge control valve 45 driven by the actuator 27. Further, this pressure control chamber 73 is constantly connected through the fuel flow passage 14, as shown in FIG. 5, to the back pressure control chamber 12.

The deep most part of the annular groove 71 and the inside end face of the first valve element 62 form between them an annular chamber 76. As shown in FIG. 6(A) and FIG. 6(B), this annular chamber 76 is connected through a plurality of communicating holes 77 formed in the second valve element 64 to the pressure control chamber 73. Therefore, the annular chamber 76 is maintained in fuel pressure to a fuel pressure the same as the fuel pressure in the pressure control chamber 73. On the other hand, a hollow chamber 78 formed inside of the first valve element 62 is constantly connected with the high pressure fuel feed passage 5*a*. Therefore, this hollow chamber 78 constantly has high pressure fuel of the high pressure fuel feed passage 5*a* led into it. The fuel pressure of this high pressure fuel acts on the facing inside end face of the second valve element 64 in the hollow chamber 78. Inside this hollow chamber 78 is inserted a compression spring 78 for biasing the second valve element 64 in a direction away from the first valve element 62.

Note that if examining the effective working areas of the fuel pressures acting on the valve elements 62, 64 in the axial direction, that is, the working areas minus the working areas on which opposing fuel pressures act, in the second embodiment shown in FIG. 6(A), the difference of the effective working areas of the effective working area of the fuel pressure in the pressure control chamber 73 acting on the outside end of the second valve element 64 minus the effective working area of the fuel pressure in the high pressure fuel feed passage 5*a* acting on the inside end of the second valve element 64 is formed larger than the difference of the effective working areas of the effective working area of the fuel pressure in the pressure control chamber 73 acting on the inside end of the first valve element 62 minus the effective working area of the fuel pressure in the high pressure fuel feed passage 5*a* acting on the outside end of the first valve element 62.

In this second embodiment as well, the opening and closing action of the opening 61 by the seat portion 66 of the first valve element 62, that is, the opening and closing action of the first valve element 62, is controlled by the pressure difference between the fuel pressure inside the high pressure fuel feed passage 5*a* acting on the outside end 65 of the first valve element 62 toward the axial direction and the fuel pressure inside the pressure control chamber 73 acting on the inside end 67 of the first valve element 62 toward the axial direction, while the opening and closing action of the opening 63 by the seat part 69 of the second valve element 64, that is, the opening and closing action of the second valve element 64, is controlled by the pressure difference between the fuel pressure in the pressure control chamber 73 acting on the outside end 70 of the second valve element 64 toward the axial line direction and the fuel pressure in the high pressure fuel feed passage 5*a* acting on the inside end 68 of the second valve element 64 toward the axial direction.

More specifically, the opening and closing actions of the first valve element 62 and second valve element 64 are performed by controlling the fuel pressure in the pressure control chamber 73 by the discharge control valve 45. In this case, the difference in the effective working area difference at the first valve element 62 and the effective working area difference at the second valve element 64 results in a time difference between the opening and closing timing of the first valve element 62 and the opening and closing timing of the second valve element 64.

Figure 8:
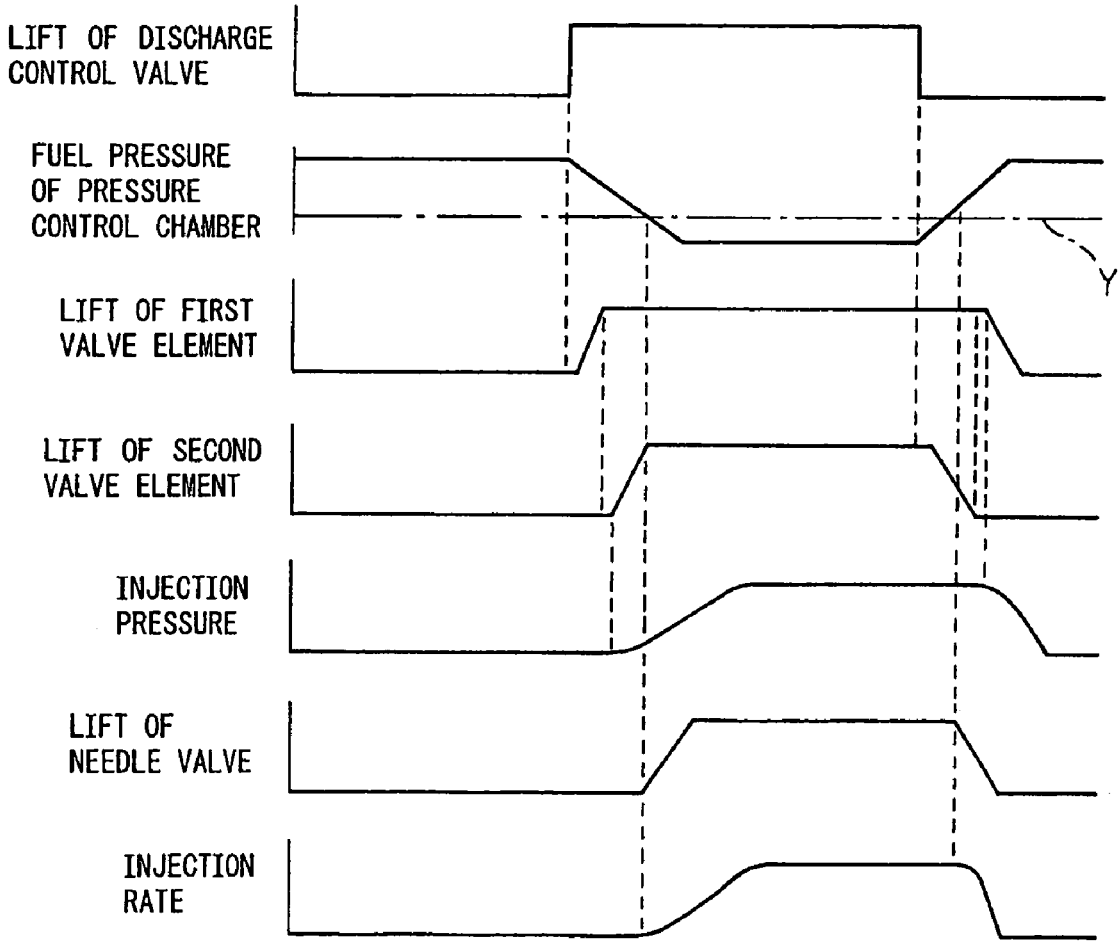
FIG. 8 is a time chart showing changes in an injection rate etc.
Figure 9:
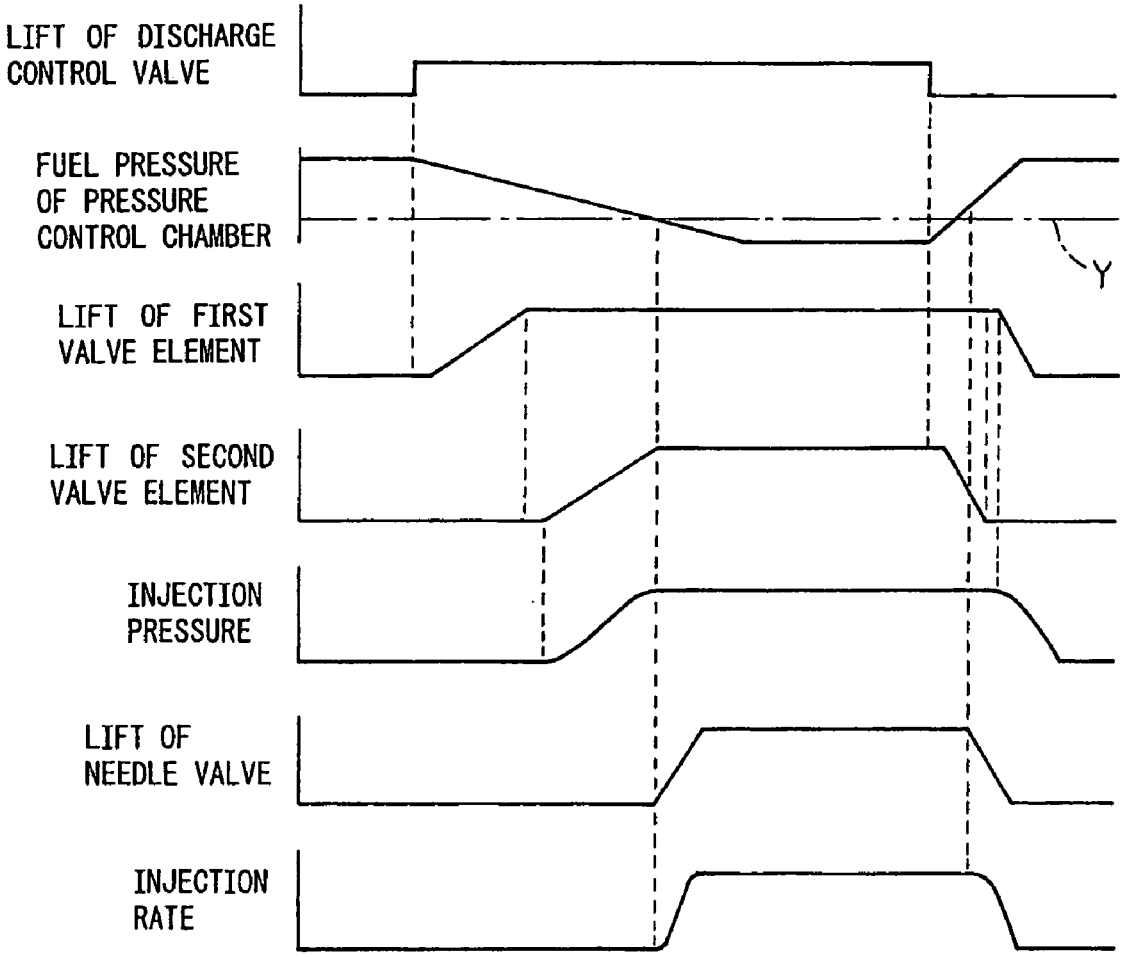
FIG. 9 is a time chart showing changes in an injection rate etc.

FIG. 8 and FIG. 9 show the changes in the fuel pressure inside the pressure control chamber 73, the amount of lift of the first valve element 62, the amount of lift of the second valve element 64, the injection pressure, the amount of lift of the needle valve 9, and the injection rate when opening the discharge control valve 45 for fuel injection. Further, FIG. 8 shows the case where the discharge control valve 45 is large in amount of lift, while FIG. 9 shows the case where the discharge control valve 45 is small in amount of lift. Next, FIG. 5 to FIG. 9 will be referred to for explanation of the method of fuel injection.

As shown in FIG. 6(A), when the discharge control valve 45 closes the constriction opening 75, the pressure control chamber 73 is connected with only the high pressure fuel feed passage 5*b*. Therefore, at this time, the fuel pressure in the pressure control chamber 73 becomes a high fuel pressure the same as the fuel pressure in the high pressure fuel feed passage 5*b*. At this time, the fuel pressure in the back pressure control chamber 12 constantly connected with the pressure control chamber 73 also becomes a high fuel pressure. Therefore, at this time, as shown in FIG. 5, the needle valve 9 is closed and the fuel injection from the injection port 10 is stopped.

On the other hand, when the fuel pressure in the pressure control chamber 73 becomes a high fuel pressure as explained above, at this time, the effective working area of the high fuel pressure acting on the second valve element 64 becomes far greater at the outside end 70 than the inside end 68, so the second valve element 64, as shown in FIG. 6(A), is held in the closed state. Further, at this time, the annular chamber 76 is also a high fuel pressure and the effective working area of the high fuel pressure acting on the inside end 67 of the first valve element 62 is equal to the effective working area of the high fuel pressure acting on the outside end 65 of the first valve element 62, so the first valve element 62 is moved by the spring force of the compression spring 79 in a direction away from the second valve element 64 and, as a result, as shown in FIG. 6(A), the first valve element 62 is held in the opened state. At this time, the fuel flow passage 15 is connected through the pressure switching chamber 60 and opening 61 to the high pressure fuel feed passage 5*a*. Therefore, at this time, the inside of the nozzle chamber 11, the inside of the high pressure chamber 20, the inside of the intermediate chamber 22, and the inside of the booster chamber 25 all become the high fuel pressure, that is, the common rail pressure. Therefore, at this time, as shown in FIG. 5, the large diameter piston 18 and small diameter piston 19 are held in the state raised by the spring force of the compression spring 23.

When switching the destination of the fuel flow passage 15 from the high pressure fuel feed passage 5*a* to the low pressure fuel return passage 26*a*, the discharge control valve 45 opens the constriction opening 75. If the discharge control valve 45 opens the constriction opening 75, the fuel in the pressure control chamber 73 starts to be discharged into the low pressure fuel return passage 26*b* and, as a result, the pressure control chamber 73 gradually falls in fuel pressure. Next, when the pressure control chamber 73 falls in fuel pressure to below the closing pressure for closing the first valve element 62, the first valve element 62, as shown in FIG. 7(A), closes. In this case, when the amount of lift of the discharge control valve 45 when the discharge control valve 45 opens the constriction opening 75 is large, the speed of fall of the fuel pressure in the pressure control chamber 73 is fast, so, as shown in FIG. 8, the first valve element 62 rapidly closes. As opposed to this, when the amount of lift of the discharge control valve 45 when the discharge control valve 45 opens the constriction opening 75 is small, the speed of fall of the fuel pressure in the pressure control chamber 73 is slow, so, as shown in FIG. 8, the first valve element 62 slowly closes.

On the other hand, the effective working area of the fuel pressure in the pressure control chamber 73 acting on the outside end 70 of the second valve element 64 is considerably larger than the effective working area of the high fuel pressure acting on the inside end 68 of the second valve element 64, so unless the pressure control chamber 73 falls in fuel pressure to a certain extent, the second valve element 64 will not open. Therefore, as shown in FIG. 7(A), FIG. 8, and FIG. 9, even when the first valve element 62 is closed, the second valve element 64 is held in a closed state.

Next, when the pressure control chamber 73 further falls in fuel pressure and the pressure control chamber 73 falls in fuel pressure to below the opening pressure for opening the second valve element 64, as shown in FIG. 7(B), the first valve element 62 remains closed and, in that state, the second valve element 64 is opened. As a result, the fuel flow passage 15 is connected through the pressure switching chamber 60 and opening 63 to the low pressure fuel return passage 26*a*. If the fuel flow passage 15 is connected with the low pressure fuel return passage 26*a*, the intermediate chamber 22 of the booster 7 gradually falls in fuel pressure and, as a result, the boosting action of the booster piston comprised of the large and small pistons 18, 19 results in the fuel pressure in the nozzle chamber 11, that is, the injection pressure, gradually increasing as shown in FIG. 8 and FIG. 9. Next, as shown in FIG. 8 and FIG. 9, when the pressure control chamber 73 falls in fuel pressure, that is, the back pressure control chamber 12 falls in fuel pressure, to below the opening pressure Y of the needle valve 9, the needle valve 9 is opened and fuel injection is started.

In this embodiment, as shown in FIG. 8, if causing the pressure control chamber 73 to rapidly drop in fuel pressure, the needle valve 9 is opened before the injection pressure increases and, as a result, the injection rate at the start of injection slowly increases. As opposed to this, as shown in FIG. 9, if causing the pressure control chamber 73 to slowly drop in fuel pressure, the needle valve 9 is opened after the injection pressure increases and, as a result, the injection rate at the start of injection rapidly increases.

In this way, in this embodiment as well, it is possible to change the amount of lift of the discharge control valve 45 so as to change the speed of fall of the fuel pressure in the pressure control chamber 73 and thereby greatly change the injection rate at the start of injection. Further, in this embodiment as well, it is possible not to change the amount of lift of the discharge control valve 45, but to change the opening speed of the discharge control valve 45 so as to change the speed of fall of the fuel pressure in the pressure control chamber 73 and thereby change the injection rate at the start of injection.

On the other hand, in this embodiment as well, when switching the destination of the fuel flow passage 15 from the high pressure fuel feed passage 5*a* to the low pressure fuel return passage 26*a*, the state as shown in FIG. 6(A) where the first valve element 62 is opened and the second valve element 64 is closed is switched through the state as shown in FIG. 7(A) where the first valve element 62 and second valve element 64 are both closed to a state as shown in FIG. 7(B) where the first valve element 62 is closed and the second valve element 64 is open. On the other hand, when switching the destination of the fuel flow passage 15 from the low pressure fuel return passage 26*a* to the high pressure fuel feed passage 5*a*, the discharge control valve 45 closes the constriction opening 75. When the discharge control valve 45 closes the constriction opening 75, the pressure control chamber 473 is supplied with fuel from the high pressure fuel feed passage 5*a*. At this time, the pressure control chamber 73 gradually rises in fuel pressure until reaching a high fuel pressure.

Therefore, at this time, the first valve element 62 and second valve element 64 switch from the state shown in FIG. 7(B) through the state shown in FIG. 7(A) to the state shown in FIG. 6(A). That is, at this time, the state where the first valve element 62 is closed and the second valve element 64 is open is switched through the state where the first valve element 62 and second valve element 64 are both closed to the state where the first valve element 62 is open and the second valve element 64 is closed.

When switching the destination of the fuel flow passage 15 from the high pressure fuel feed passage 5*a* to the low pressure fuel return passage 26*a*, the valve elements 62 and 64 are made to move in the order of FIG. 6(A), FIG. 7(A), and FIG. 7(B), but during this time, the high pressure fuel feed passage 5*a* is not connected with the low pressure fuel return passage

26*a* in the pressure switching chamber 60 and consequently a large amount of high pressure fuel does not leak into the low pressure fuel return passage 26*a*. On the other hand, even when switching the destination of the fuel flow passage 15 from the low pressure fuel return passage 26*a* to the high pressure fuel feed passage 5*a*, the high pressure fuel feed passage 5*a* is not connected with the low pressure fuel return passage 26*a* in the pressure switching chamber 60 and consequently a large amount of high pressure fuel can be prevented from leaking into the low pressure fuel return passage 26*a*.

Figure 10:
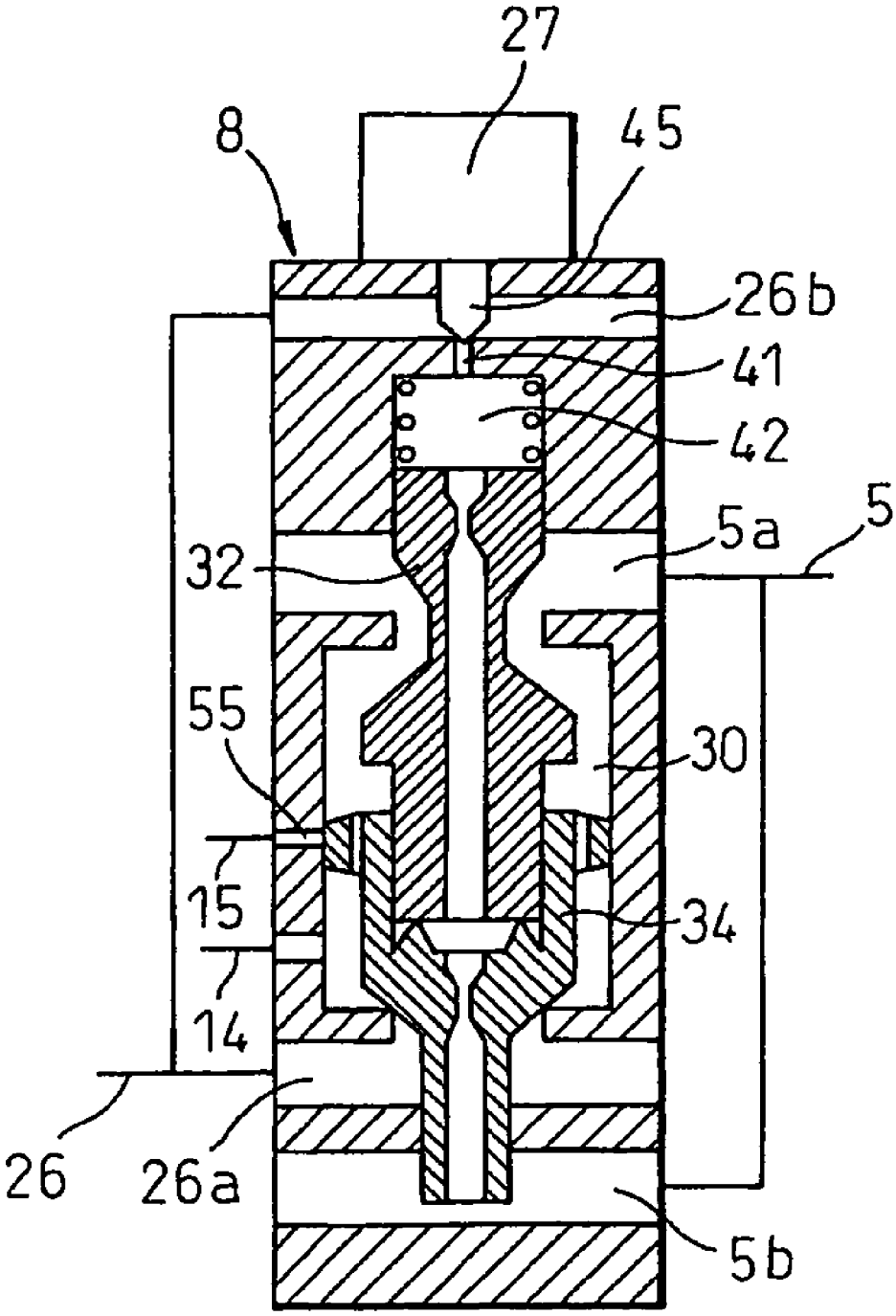
FIG. 10 is a side sectional view of a third embodiment of a three-way valve.
Figure 11:
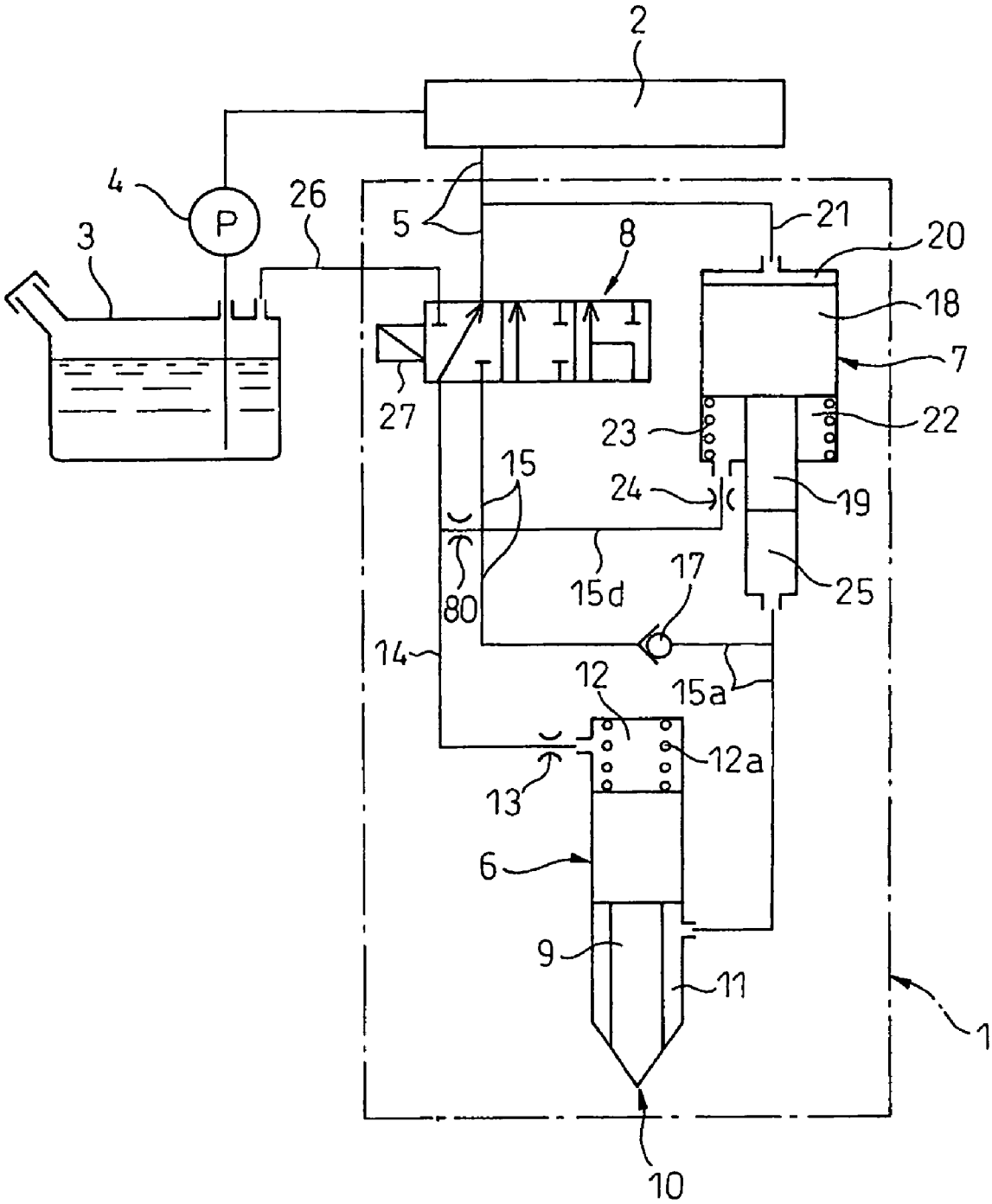
FIG. 11 is an overview of a fuel injection system.

FIG. 10 shows a three-way valve 8 having exactly the same structure as the three-way valve 8 shown in FIG. 2(A). However, in the embodiment shown in FIG. 10, unlike the embodiment shown in FIG. 2(A), the fuel flow passage 14 is constantly connected with the pressure switching chamber 30, and the fuel flow passage 15 is connected with the pressure control port 55. That is, the fuel injection system when using the three-way valve 8 shown in FIG. 10 becomes overall one as shown in FIG. 11. As will be understood from FIG. 10 and FIG. 11, the pressure switching chamber 30 is connected through the fuel flow passage 14 with the back pressure control chamber 12, while the pressure control port 55 is connected through the fuel flow passages 15, 15*a*, 15*d* to the nozzle chamber 11, intermediate chamber 22, and booster chamber 25. Note that in this embodiment, high pressure fuel is fed to the nozzle chamber 11, intermediate chamber 22, and booster chamber 25 by having the fuel flow passage 15 connected through the constriction 80 to the fuel flow passage 14. This constriction 80 has a flow cross-sectional area smaller than the constriction 13 and constriction 24.

Figure 12:
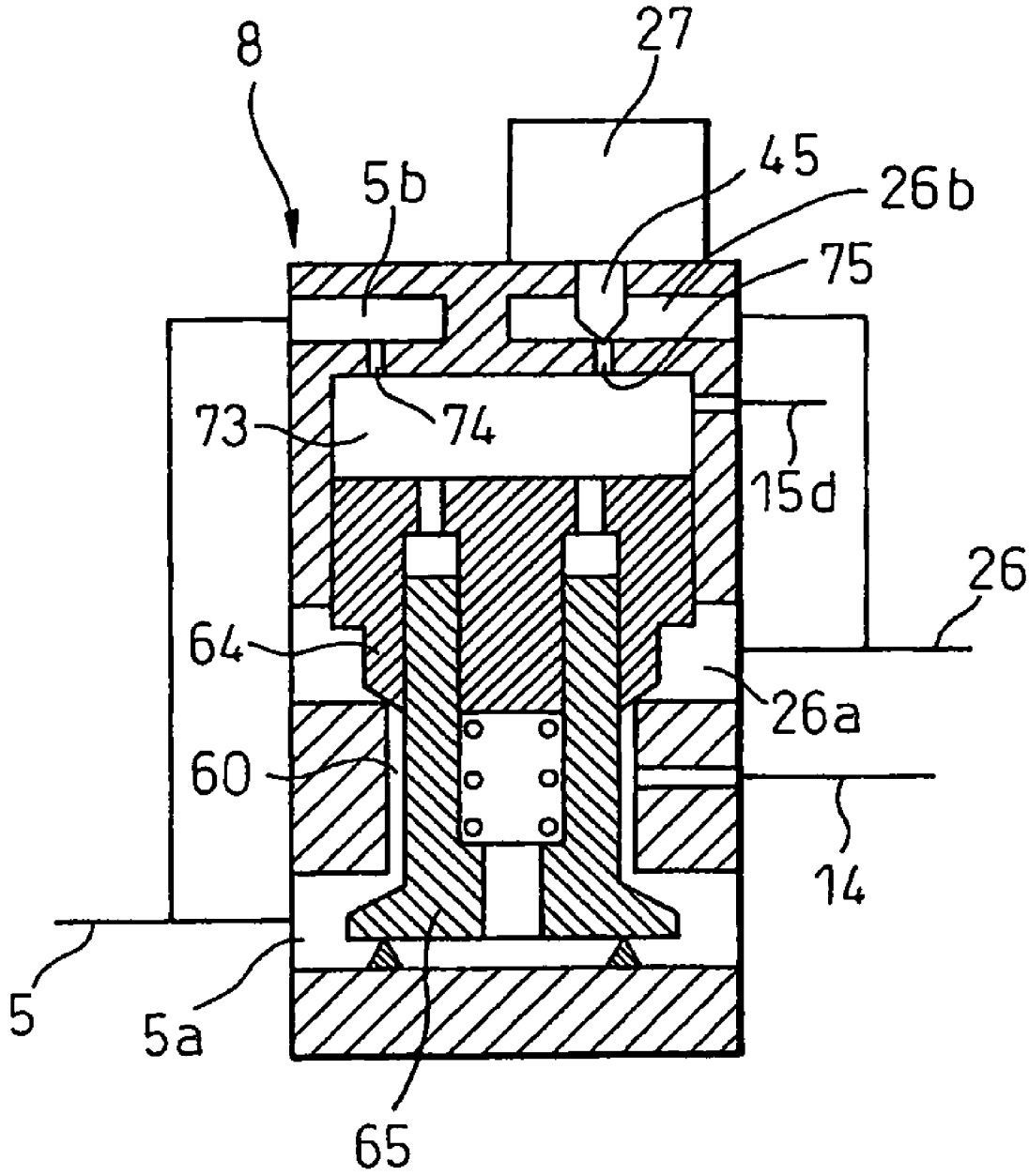
FIG. 12 is a side sectional view of a fourth embodiment of a three-way valve.
Figure 13:
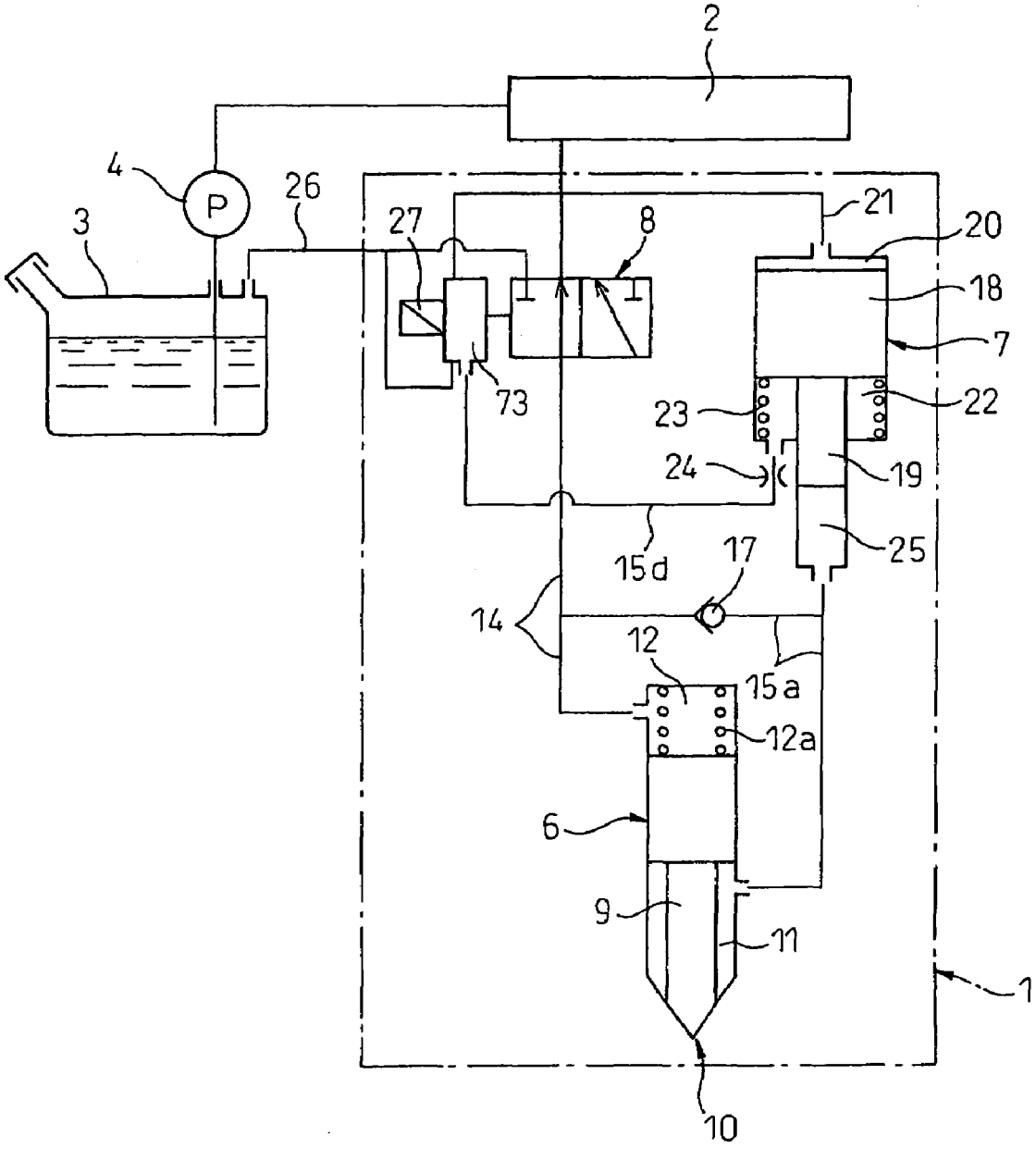
FIG. 13 is an overview of a fuel injection system.

FIG. 12 shows a three-way valve 8 having exactly the same structure as the three-way valve 8 shown in FIG. 6(A). However, in the embodiment shown in FIG. 12, unlike the embodiment shown in FIG. 6(A), the fuel flow passage 14 is constantly connected with the pressure switching chamber 60, and the fuel flow passage 15*d* is connected with the pressure control chamber 73. That is, the fuel injection system when using the three-way valve 8 shown in FIG. 12 becomes overall one as shown in FIG. 13. As shown in FIG. 12 and FIG. 13, the pressure switching chamber 60 is connected through the fuel flow passages 14, 15*a* to the nozzle chamber 11, back pressure control chamber 12, and booster chamber 25, while the pressure control chamber 73 is connected through the fuel flow passage 15*d* to the intermediate chamber 22.

In the embodiments shown in FIG. 10 to FIG. 13, when the discharge control valve 45 opens, the needle valve 9 is opened and fuel injection starts, then the booster piston comprised of the large and small pistons 18, 19 acts to increase the injection pressure. Therefore, in these embodiments, the injection rate at the start of injection is small and the injection rate increases a little while after the start of injection. Note that in these embodiments as well, it is possible to change the amount of lift or opening speed of the discharge control valve 45 to control the timing of increase of the injection rate to the optimal timing for the engine operating state.

The invention claimed is:

1. A fuel injection system provided with a three-way valve able to selectively connect a back pressure control chamber formed on an inside end face of a needle valve and an intermediate chamber of a booster piston for increasing an injection pressure to a high pressure fuel feed passage or low pressure fuel return passage and, control for opening and closing a needle valve and control for increasing the injection pressure by the booster piston are performed by using the fuel passage switching action by the three-way valve, wherein a pressure switching chamber constantly connected to either the back pressure control chamber or intermediate chamber is formed in the three-way valve, the high pressure fuel feed passage is open to one side of the pressure switching chamber, a first valve element for controlling the opening and closing of the opening of the high pressure fuel feed passage is provided, the low pressure fuel return passage is open to the other side of the pressure switching chamber, a second valve element for controlling the opening and closing of the opening of this low pressure fuel return passage is provided, the three-way valve is provided with a pressure control chamber, fuel pressure in the pressure control chamber is controlled so as to control a pressure difference of fuel pressures acting at the two ends of the first valve element in an axial direction of the first valve element and a pressure difference of fuel pressures acting at the two ends of the second valve element in an axial direction of the second valve element so that when switching the destination of either the back pressure control chamber or intermediate chamber from the high pressure fuel feed passage to the low pressure fuel return passage, the state where the first valve element is open and the second valve element is closed is changed through a state where the first valve element and second valve element are both closed to a state where the first valve element is closed and the second valve element is open and so that when switching the destination of either the back pressure control chamber or intermediate chamber from the low pressure fuel return passage to the high pressure fuel feed passage, the state where the first valve element is closed and the second valve element is open is changed through a state where the first valve element and second valve element are both closed to a state where the first valve element is open and the second valve element is closed, and the other of the back pressure control chamber or intermediate chamber is connected with the pressure switching chamber when second valve element is open or is constantly connected with the pressure control chamber.

2. A fuel injection system as set forth in claim 1, wherein the first valve element and second valve element are arranged on a common axis, an inside end of the first valve element and an inside end of the second valve element are engaged to be able to slide relative to each other, said pressure control chamber is formed at an outside end of first valve element, fuel pressure in said pressure control chamber is made to act on the outside end of the first valve element toward the axial direction, an intermediate pressure chamber is formed between the engaged inside end of the first valve element and inside end of the second valve element, fuel pressure in said intermediate pressure chamber is made to act on the inside end of the first valve element and the inside end of the second valve element toward the axial direction, fuel pressure in the high pressure fuel feed passage is made to act on the outside end of the second valve element toward the axial direction, a sliding seal face sliding on the inner circumference of the pressure switching chamber is formed on the outer circumference of the second valve element, a pressure control port which is sealed by said sliding seal face when second valve element is closed and opens to the pressure switching chamber when the second valve element opens by a certain opening degree or more is formed at the inner circumferencial face of the pressure switching chamber, the other of said back pressure control chamber or intermediate chamber is connected with said pressure control port, when switching the destination of one of said back pressure control chamber or intermediate chamber from the high pressure fuel feed passage to the low pressure fuel return passage, in a state where the first valve element is open and the second valve element is closed, the fuel pressure in the pressure control chamber is lowered to below a closing pressure of the first valve element to make the first valve element close, then the pressure in the intermediate pressure chamber is lowered to below an opening pressure of the second valve element to make the second valve element open, and, when switching the destination of one of said back pressure control chamber or intermediate chamber from the low pressure fuel return passage to the high pressure fuel feed passage, in a state where the first valve element is closed and the second valve element is opened, the fuel pressure in the intermediate pressure chamber is raised to above the closing pressure of the second valve element to make the second valve element close, then the fuel pressure in the pressure control chamber is raised to above the opening pressure of the first valve element to make the first valve element open.

3. A fuel injection system as set forth in claim 2, wherein the pressure control chamber is connected through a fuel passage and constriction formed in the first valve element to the intermediate pressure chamber, the intermediate pressure chamber is connected through a fuel passage and constriction formed in the second valve element to the high pressure fuel feed passage, a discharge control valve for causing discharge of fuel in the pressure control chamber is provided, and said discharge control valve is controlled to open and close to control the fuel pressure in the pressure control chamber and the fuel pressure in the intermediate pressure chamber.

4. A fuel injection system as set forth in claim 1, wherein the first valve element and second valve element are arranged on a common axis, an inside end of the first valve element and an inside end of the second valve element are engaged to be able to slide relative to each other, said pressure control chamber is formed at an outside end of second valve element, fuel pressure in said pressure control chamber is made to act on the inside end of the first valve element and the outside end of the second valve element toward the axial direction, fuel pressure in the high pressure fuel feed passage is made to act on the outside end of the first valve element and inside end of the second valve element in the axial direction, the other of said back pressure control chamber or intermediate chamber is constantly connected with the pressure control chamber, when switching the destination of one of said back pressure control chamber or intermediate chamber from the high pressure fuel feed passage to the low pressure fuel return passage, in a state where the first valve element is open and the second valve element is closed, the fuel pressure in the pressure control chamber is gradually lowered to make the first valve element close, then make the second valve element open, and, when switching the destination of one of said back pressure control chamber or intermediate chamber from the low pressure fuel return passage to the high pressure fuel feed passage, in a state where the first valve element is closed and the second valve element is open, the fuel pressure in the pressure control chamber is gradually increased to make the second valve element close, then make the first valve element open.

5. A fuel injection system as set forth in claim 4, wherein the difference of the effective working areas of the effective working area of the fuel pressure in the pressure control chamber acting on the outside end of the second valve element minus the effective working area of the fuel pressure in the high pressure fuel feed passage acting on the inside end of the second valve element is formed larger than the difference of the effective working areas of the effective working area of the fuel pressure in the pressure control chamber acting on the inside end of the first valve element minus the effective working area of the fuel pressure in the high pressure fuel feed passage acting on the outside end of the first valve element, the pressure control chamber is connected through a constriction to the high pressure fuel feed passage, a discharge control valve for making fuel in the pressure control chamber discharge is provided, and said discharge control valve is controlled to open and close to control the fuel pressure in the pressure control chamber.

6. A fuel injection system as set forth in claim 5, wherein an annular groove connected with said pressure control chamber and forming an annular shape around said common axial line is formed in the second valve element, a first valve element forming a hollow cylindrical shape is slidably inserted from the inside end side of the second valve element to said annular groove, fuel in the high pressure fuel feed passage is led to the hollow part of the first valve element, and the fuel pressure of this fuel acts on the inside end of second valve element.

* * * * *